US009377023B2

(12) United States Patent
Sowa et al.

(10) Patent No.: US 9,377,023 B2
(45) Date of Patent: Jun. 28, 2016

(54) AIR COMPRESSOR

(75) Inventors: Masato Sowa, Aichi-ken (JP); Fumihiro Suzuki, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 140 days.

(21) Appl. No.: 13/339,545

(22) Filed: Dec. 29, 2011

(65) Prior Publication Data

US 2012/0177526 A1 Jul. 12, 2012

(30) Foreign Application Priority Data

Jan. 12, 2011 (JP) ..... 2011-003688

(51) Int. Cl.

| | |
|---|---|
| ***F01C 1/00*** | (2006.01) |
| ***F01C 1/18*** | (2006.01) |
| ***F01C 11/00*** | (2006.01) |
| ***F03C 2/00*** | (2006.01) |
| ***F03C 4/00*** | (2006.01) |
| ***F04C 2/00*** | (2006.01) |
| ***F01C 1/24*** | (2006.01) |
| ***F04C 29/06*** | (2006.01) |
| ***F04C 29/12*** | (2006.01) |
| *F04C 18/12* | (2006.01) |

(52) U.S. Cl.

CPC ..... *F04C 29/061* (2013.01); *F04C 29/063* (2013.01); *F04C 29/12* (2013.01); *F04C 18/126* (2013.01)

(58) Field of Classification Search

CPC ..... F04C 29/061; F04C 29/063; F04C 29/12; F04C 18/126

USPC ..... 418/206.1, 206.2, 206.4, 15

See application file for complete search history.

(56) References Cited

U.S. PATENT DOCUMENTS

| | | | | |
|---|---|---|---|---|
| 2,612,022 | A * | 9/1952 | Keys | 60/39.35 |
| 3,769,944 | A * | 11/1973 | Raymond | 123/235 |
| 5,046,935 | A | 9/1991 | Iio et al. | |
| 5,507,151 | A | 4/1996 | Ring et al. | |
| 6,283,734 | B1 * | 9/2001 | Blume | F04C 2/086 418/1 |

(Continued)

FOREIGN PATENT DOCUMENTS

| | | |
|---|---|---|
| DE | 701616 | 1/1941 |
| DE | 4007749 | 10/1990 |

(Continued)

OTHER PUBLICATIONS

Search report from E.P.O., mail date is Jan. 30, 2013.

(Continued)

*Primary Examiner* — Jesse Bogue
*Assistant Examiner* — Dapinder Singh
(74) *Attorney, Agent, or Firm* — Greenblum & Bernstein, P.L.C.

(57) ABSTRACT

An air compressor includes a compression mechanism for compressing intake air and discharging the compressed air, and an intake chamber portion through which intake air is introduced into the compression mechanism. The intake chamber portion has an inlet of intake air and an outlet connected to the compression mechanism. The intake chamber portion is integrated with the compression mechanism. The intake chamber portion has therein a partition wall extending in the direction from the inlet toward the outlet to form plural flow passages in the intake chamber portion. The plural flow passages have different flow path lengths and connect between the inlet and the outlet.

5 Claims, 3 Drawing Sheets

(56) References Cited

U.S. PATENT DOCUMENTS

| | | | | |
|---|---|---|---|---|
| 6,804,360 | B1 | 10/2004 | Misawa et al. | |
| 7,578,659 | B2 * | 8/2009 | Fox et al. | 417/312 |
| 2004/0182357 | A1 * | 9/2004 | Makler | 123/241 |
| 2005/0106054 | A1 | 5/2005 | Daniels et al. | |

FOREIGN PATENT DOCUMENTS

| | | |
|---|---|---|
| JP | 50-33806 | 4/1975 |
| JP | 53-87338 | 7/1978 |
| JP | 63-162913 | 10/1988 |
| JP | 7-133774 | 5/1995 |
| JP | 2000-120497 | 4/2000 |
| JP | 2003-285647 | 10/2003 |
| JP | 2005-233455 | 9/2005 |
| JP | 2007-146662 | 6/2007 |
| JP | 2008-52969 | 3/2008 |
| JP | 2009-248866 | 10/2009 |

OTHER PUBLICATIONS

Office Action from Japan Patent Office (JPO) in Japanese Patent Application No. 2011-003688, dated Oct. 31, 2013.

Office Action fromm Japan Patent Office (JPO) in Japanese Patent Application No. 2011-003688, dated May 27, 2014.

* cited by examiner

AIR COMPRESSOR

BACKGROUND OF THE INVENTION

The present invention relates to an air compressor.

To reduce carbon dioxide emissions, development of an electric vehicle using a fuel cell has been conducted. The fuel cell generates electric power through an electrochemical reaction between oxygen and hydrogen which are supplied to the cathode and the anode of the fuel cell, respectively. In such electric vehicle, an air compressor is used for compressing air and oxygen in the compressed air is supplied to the cathode of the fuel cell. There is generally a problem of noise occurring from the intake and discharge ports of the air compressor and, therefore, various compressors have been developed to reduce such noise.

For example, Japanese Unexamined Patent Application Publication No. 2003-285647 discloses an arrangement of an air compressor and its related components in a fuel cell vehicle for reduction of noise development around the compressor. In the publication, an air cleaner is connected through a rubber tube to the intake side of the compressor, and a chamber or plenum chamber forming therein a box shaped space is provided between the rubber tube and the intake side of the compressor in order to reduce the radiation noise from the rubber tube due to the intake pulsation noise generated at the intake side of the compressor. The plenum chamber is provided therein with a sound absorber. The plenum chamber functions to reduce the intake pulsation noise from the intake side of the compressor, resulting in a reduction of the radiation noise from the rubber tube which is difficult to be reduced because of low rigidity of the rubber tube.

The arrangement disclosed in the publication No. 2003-285647 in which the plenum chamber is connected to the intake side of the compressor requires a large space for installation of both of the compressor and the plenum chamber in a vehicle. Such large installation space affects the arrangement of many other components in a vehicle and hence is difficult to be provided. In addition, when the compressor and the plenum chamber need to be spaced away from each other in the installation thereof because of limited layout space in a vehicle, radiation noise due to the intake pulsation noise may be generated from a tube connecting between the compressor and the plenum chamber.

The present invention is directed to providing an air compressor that requires less installation space and allows reduction of noise development.

SUMMARY OF THE INVENTION

In accordance with an aspect of the present invention, an air compressor includes a compression mechanism for compressing intake air and discharging the compressed air, and an intake chamber portion through which intake air is introduced into the compression mechanism. The intake chamber portion has an inlet of intake air and an outlet connected to the compression mechanism. The intake chamber portion is integrated with the compression mechanism. The intake chamber portion has therein a partition wall extending in the direction from the inlet toward the outlet to form plural flow passages in the intake chamber portion. The plural flow passages have different flow path lengths and connect between the inlet and the outlet.

Other aspects and advantages of the invention will become apparent from the following description, taken in conjunction with the accompanying drawings, illustrating by way of example the principles of the invention.

DETAILED DESCRIPTION OF THE EMBODIMENTS

Figure 1:
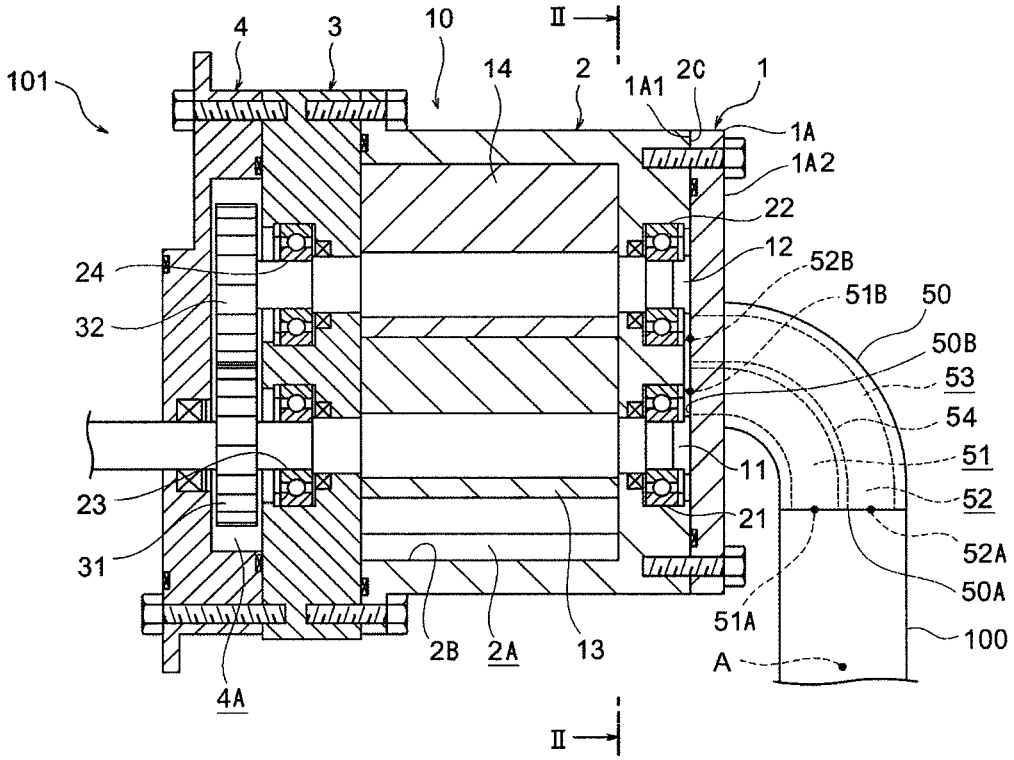
FIG. 1 is a sectional view of an air compressor according to a first embodiment of the present invention.
Figure 2:
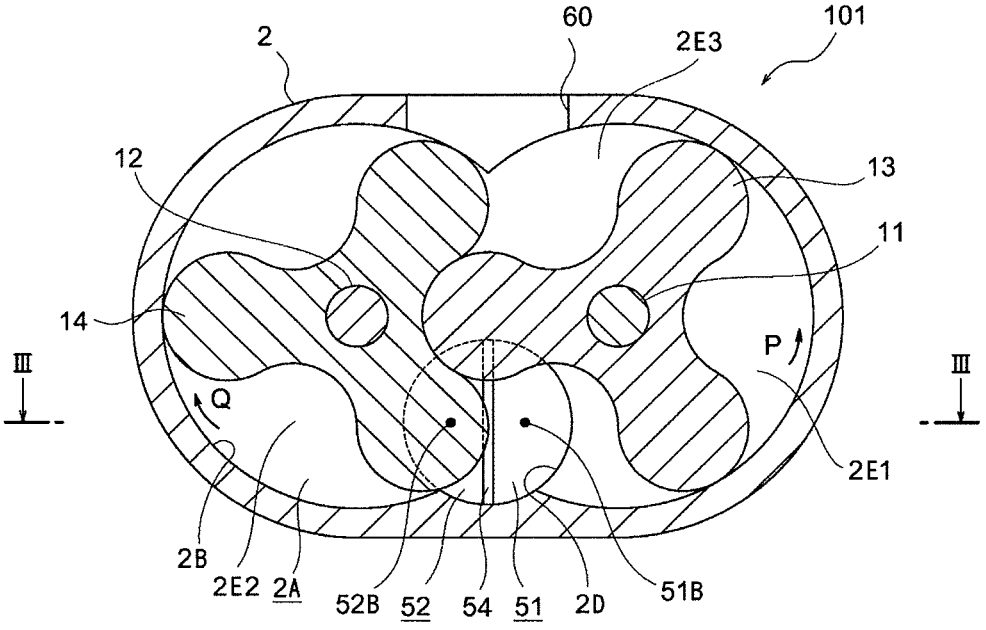
FIG. 2 is a sectional view taken along the line II-II of FIG. 1.
Figure 3:
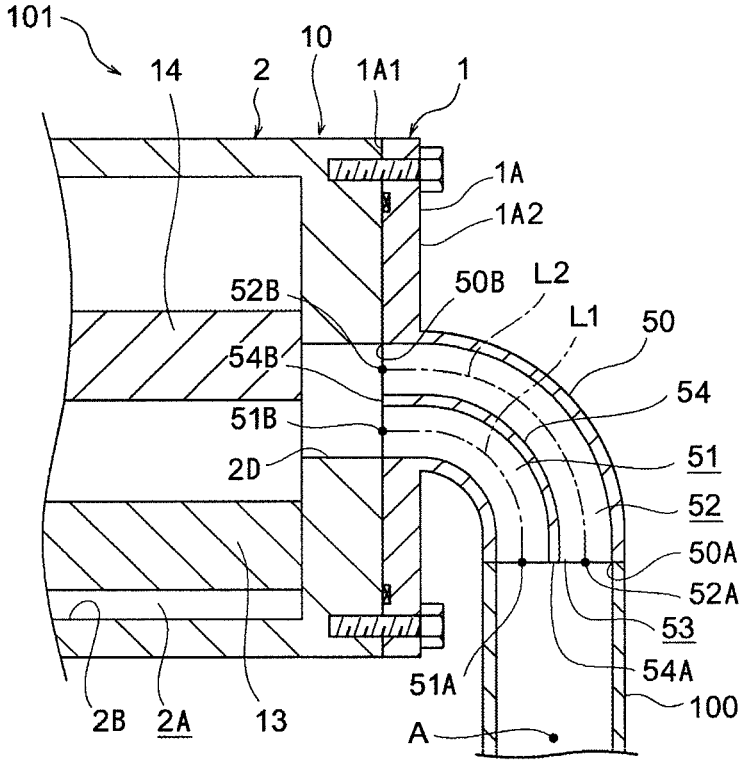
FIG. 3 is a sectional view taken along the line III-III of FIG. 2.

The following will describe the embodiments of the air compressor according to the present invention with reference to the attached drawings. Referring to FIGS. 1 through 3, the air compressor of the first embodiment designated generally by 101 is a roots compressor which is intended for use in an automotive fuel cell system and in which high frequency intake pulsation occurs.

As shown in FIG. 1, the air compressor 101 has a shell 2 having a pump chamber 2A and a front housing 3 fastened to the shell 2 by bolts to close the pump chamber 2A. A gear housing 4 is fastened by bolts to the side of the front housing 3 opposite from the shell 2 and cooperates with the front housing 3 to form a closed gear chamber 4A therebetween.

The air compressor 101 has a main shaft 11 extending through the shell 2, the front housing 3 and the gear housing 4, and a driven shaft 12 extending through the shell 2 and the front housing 3 into the gear chamber 4A of the gear housing 4. Although not shown in the drawing, one end of the main shaft 11 extending out of the gear housing 4 is connected to a drive unit such as an electric motor. The main shaft 11 is radially supported by ball bearings 21, 23 provided in the shell 2 and the front housing 3, respectively, and similarly the driven shaft 12 is radially supported by ball bearings 22, 24 provided in the shell 2 and the front housing 3, respectively.

The air compressor 101 has a first rotor 13 and a first gear 31 provided in the pump chamber 2A and the gear chamber 4A, respectively, and fixed on the main shaft 11 for rotation therewith. The air compressor 101 also has a second rotor 14 and a second gear 32 provided in the pump chamber 2A and the gear chamber 4A, respectively, and fixed on the driven shaft 12 for rotation therewith.

As shown in FIG. 2, the first and second rotors 13, 14 have substantially the same shape having three lobes. The first and second rotors 13, 14 are engaged with each other in the pump chamber 2A in such a manner that the lobe of one rotor is disposed between any two adjacent lobes of the other rotor.

Referring back to FIG. 1, when the main shaft 11 is driven to rotate, for example, by an electric motor, the driven shaft 12 is rotated at the same speed as the main shaft 11 through the first and second gears 31, 32 engaged with each other in the gear chamber 4A, so that the first and second rotors 13, 14 mounted on the main and driven shafts 11, 12 are rotated at the same speed but in the opposite directions. The gear housing 4, the front housing 3, the shell 2, the first and second rotors 13, 14, the main and driven shafts 11, 12, the first and second gears 31, 32, and their related components cooperate to function as a compression mechanism 10 that compresses intake air and then discharges the compressed air.

The air compressor 101 further has a rear housing 1 provided on the end 2C of the shell 2 so as to cover the ends of the respective main and driven shafts 11, 12. The rear housing 1 has a plate portion 1A and a cylindrical connecting portion 50 formed integrally with each other. The plate portion 1A is in contact at the end surface 1A1 thereof with the end 2C of the shell 2 and fastened to the shell 2 by bolts. The connecting portion 50 projects from the end surface 1A2 of the rear housing 1 that is opposite from the end surface 1A1. The connecting portion 50 is integrated with the shell 2 of the compression mechanism 10. The connecting portion 50 has a curved shape. With the air compressor 101 installed in a vehicle, the connecting portion 50 is connected to an intake tube 100 that is in turn connected to a component such as an air cleaner (not shown).

As shown in FIGS. 2 and 3, the curved connecting portion 50 forms therein a curved cylindrical chamber 53 or a curved cylindrical flow passage. The chamber 53 extends through the plate portion 1A of the rear housing 1 and is opened through the end surface 1A1 of the rear housing 1, thereby forming an outlet 50B of the connecting portion 50. The chamber 53 is opened at the end of the connecting portion 50 opposite from the shell 2, thereby forming an inlet 50A of the connecting portion 50. The direction in which the inlet 50A is opened is different from the direction in which the outlet 50B is opened. The shell 2 is formed therethrough with a hole 2D which is aligned in position with the outlet 50B of the chamber 53 and through which the chamber 53 and the pump chamber 2A are communicable. The hole 2D functions as an intake port of the pump chamber 2A. As shown in FIG. 2, a discharge port 60 of the pump chamber 2A is formed in the shell 2 on the side of the first and second rotors 13, 14 opposite from the hole 2D.

The connecting portion 50 of the rear housing 1 is directly connected to the hole 2D of the shell 2 that is the intake port of the pump chamber 2A. The chamber 53 of the connecting portion 50 and the hole 2D of the shell 2 connect the intake tube 100 to the pump chamber 2A. The connecting portion 50 corresponds to the intake chamber portion of the present invention.

The connecting portion 50 has a partition wall 54 formed in the chamber 53 so as to divide the chamber 53 into two flow spaces along the extension of the connecting portion 50 from the inlet 50A toward the outlet 50B thereof or along the axis of the chamber 53. The partition wall 54 extends from the inlet 50A to the outlet 50B along the curved shape of the chamber 53. The partition wall 54 divides the chamber 53 into two flow passages, namely a first chamber 51 and a second chamber 52 having substantially the same cross-sectional area across the axis of the chamber 53 and connecting between inlet 50A and the outlet 50B.

The partition wall 54 is formed so that the flow path length L1 of the first chamber 51 measured between its central points 51A, 51B at the respective inlet 50A and the outlet 50B differs from the flow path length L2 of the second chamber 52 measured between its central points 52A, 52B at the respective inlet 50A and outlet 50B. In the present embodiment, the flow path length L2 is greater than the flow path length L1. The rear housing 1 including the connecting portion 50 cooperates with the compression mechanism 10 to form the air compressor 101 or an air compressor assembly to be supplied to the market.

The following will describe the operation of the air compressor 101 with reference to FIGS. 1 through 4. When the main shaft 11 having the first gear 31 and the first rotor 13 fixed thereto is rotated, for example, by an electric motor, the second gear 32 engaged with the first gear 31 is rotated, and the driven shaft 12 fixed to the second gear 32 is rotated with the second rotor 14.

Referring to FIG. 2, the main shaft 11 and the first rotor 13 are rotated in the counterclockwise direction indicated by arrow P, while the driven shaft 12 and the second rotor 14 are rotated in the clockwise direction indicated by Q. In accordance with the rotation of the first and second rotors 13, 14, a vacuum is generated in the intake region of the air compressor 101 adjacent to the hole 2D, so that intake air is introduced into the pump chamber 2A through the intake tube 100, the first and second chambers 51, 52 of the connecting portion 50 and the hole 2D. The air thus introduced is trapped in the spaces 2E1, 2E2 surrounded by the inner surface 2B of the pump chamber 2A and the associated first and second rotors 13, 14, and then carried along the inner surface 2B of the pump chamber 2A in the directions P, Q while being compressed. The compressed air is discharged out of the shell 2 through the discharge port 60 and supplied as oxidizing agent to a cathode of the fuel cell (not shown).

When the first and second rotors 13, 14 are rotated in the respective directions P, Q, the space 2E3 located adjacent to the discharge port 60 and surrounded by the inner surface 2B of the pump chamber 2A and the first and second rotors 13, 14 is moved toward the hole 2D and then connected to the intake hole 2D. At this time, the compressed air remaining in the space 2E3 is released rapidly into the hole 2D due to the pressure difference between the space 2E3 and the hole 2D, thereby causing intake pulsation noise.

Referring to FIG. 3, acoustic wave of the intake pulsation travels through the hole 2D and then separately through the first and second chambers 51, 52. The separate acoustic waves travel out of the respective first and second chambers 51, 52 at the inlet 50A of the connecting portion 50, and then join together in the intake tube 100. The acoustic wave traveling through the intake tube 100 may cause intake noise at the opened end of the intake tube 100 (not shown) and also radiation noise from the outer periphery of the intake tube 100. According to the present embodiment, however, the flow path length L2 of the second chamber 52 is greater than the flow path length L1 of the first chamber 51, and the acoustic wave after passing through the first chamber 51 and the acoustic wave after passing through the second chamber 52 have different phases at the inlet 50A of the connecting portion 50. Such phase difference due to the difference in the flow path length causes the acoustic waves after passing through the respective first and second chambers 51, 52 to cancel each other at a position in the intake tube 100 adjacent to the inlet 50A, so that the sound pressure level of the resulting acoustic wave is reduced. Thus, the air compressor 101 allows reduction of the noise caused by intake pulsation and emitted from the inlet 50A, as well as reduction of intake noise at the open end of the intake tube 100 and of radiation noise from the intake tube 100, as compared to the case that the chamber 53 is not divided into two flow passages.

Figure 4:
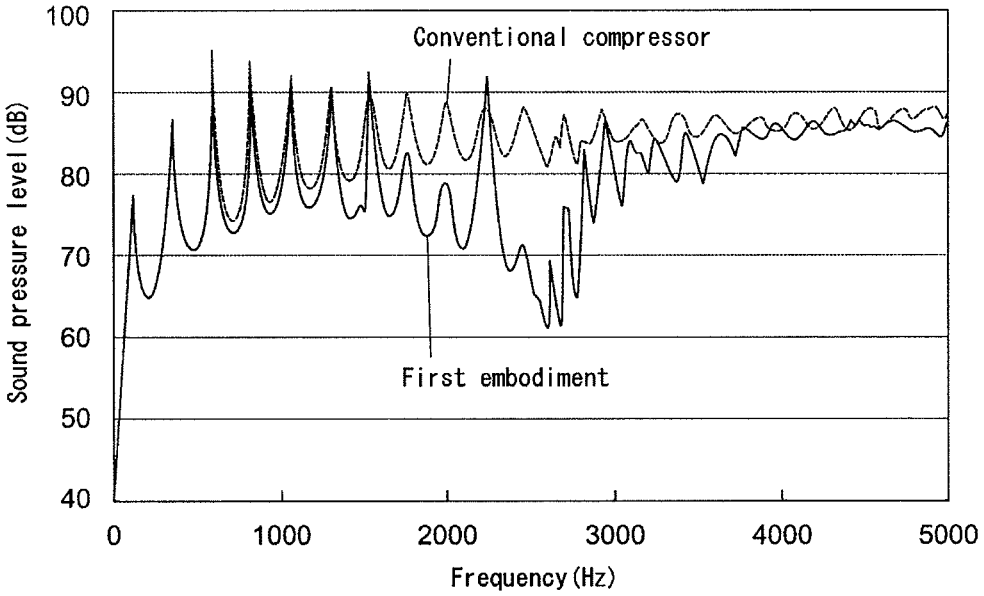
FIG. 4 is a graph showing the sound pressure level of intake pulsation noise, comparing between the air compressor of the first embodiment and a conventional air compressor.

FIG. 4 shows a graph of sound pressure level (dB) against frequency (Hz) at the intake side of the air compressor 101, measured at the point A in the intake tube 100 (see FIGS. 1, 3), comparing with a conventional compressor having no partition wall such as 54 (see FIG. 1). In the graph, the vertical axis represents the sound pressure level (dB), and the horizontal axis represents the frequency (Hz).

As shown in the graph, the sound pressure level of the noise generated from the intake side of the air compressor 101 is lower than that of the conventional compressor over a wide frequency range and, therefore, the air compressor 101 of the present embodiment provides a significant noise reduction, particularly in high-frequency range above 1500 Hz, as compared to the conventional compressor. In the air compressor 101 of the present embodiment, the sound pressure level is significantly reduced in the frequency range of 2000 to 3000 Hz, and a significant reduction of sound pressure level in the desired frequency range may be accomplished by changing the difference between the flow path lengths L1, L2 of the respective first and second chamber 51, 52.

As described above, in the air compressor 101 according to the first embodiment, the connecting portion 50 has the inlet 50A of intake air and the outlet 50B connected to the intake side of the compression mechanism 10 that compresses intake air and then discharges the compressed air. In the connecting portion 50, the partition wall 54 extends in the direction from the inlet 50A toward the outlet 50B and forms two flow passages, namely, the first and second chambers 51, 52 having different flow path lengths and connecting between the inlet 50A and the outlet 50B. The connecting portion 50 is integrated with the compression mechanism 10.

Since the flow path length L1 of the first chamber 51 differs from the flow path length L2 of the second chamber 52, the intake pulsation noises of the compression mechanism 10 after passing through such first and second chambers 51, 52 have different phases at the inlet 50A of the connecting portion 50 and are cancelled, thereby resulting in reduced sound pressure level of the noise. That is, the noise reduction in the air compressor 101 is achieved by interference between the intake pulsation noises at the inlet 50A as the intake port of the air compressor 101. In addition, with respect to the intake pulsation noise whose sound pressure level has not been lowered by noise reduction in the air compressor 101, the area of the outer surface of the connecting portion 50 on which the radiation noise due to the intake pulsation is generated is small, thus resulting in a reduced radiation noise from the connecting portion 50. In addition, the provision of the partition wall 54 in the connecting portion 50 increases the rigidity of the connecting portion 50, resulting in a reduced vibration of the air compressor 101 and also a reduced radiation noise from the connecting portion 50. Furthermore, the noise reduction in the air compressor 101 is accomplished only by providing the partition wall 54 in the connecting portion 50 that is integrated with the compression mechanism 10, thus resulting in a reduced size of the air compressor 101. Thus, the air compressor 101 of the present embodiment requires less installation space and allows reduction of noise development. Noise reduction in the air compressor 101 is achieved by interference between intake pulsation noises which is caused by the partition wall 54 provided in the connecting portion 50 and, therefore, there is no need to provide any additional member such as a sound absorber. Therefore, a trouble with the air compressor 101 caused by the ingress of any foreign matter such as chips of sound absorber into the compression mechanism 10 may be avoided.

In the air compressor 101, the direction in which the inlet 50A of the connecting portion 50 is opened is different from the direction in which the outlet 50B is opened. Since the connecting portion 50 is not linear but curved, the first and second chambers 51, 52 having different flow path lengths can be formed easily only by bending the partition wall 54 along the axis of the chamber 53 of the connecting portion 50.

In the air compressor 101, the first and second chambers 51, 52 of the connecting portion 50 have substantially the same cross-sectional area and, therefore, the sound pressure levels of the intake pulsation noises in the first and second chambers 51, 52 are maintained at an equivalent level. Thus, when one of the intake pulsation noises has a higher sound pressure level, the intake pulsation noises after passing through the first and second chambers 51, 52 are cancelled at the inlet 50A, but the resulting noise has a relatively high sound pressure level due to the influence of the intake pulsation noise of the higher sound pressure level before passing through the connecting portion 50. On the other hand, the intake pulsation noises having an equivalent sound pressure level are cancelled efficiently.

In the air compressor 101, the connecting portion 50 cooperates with the compression mechanism 10 to form an air compressor assembly. The connecting portion 50 is a part for connecting the air compressor 101 to the any peripheral component such as the intake tube 100 and included in the air compressor assembly to be supplied to the market. Noise reduction of the air compressor 101 is achieved only by providing the partition wall 54 in the connecting portion 50 that is typically included in the air compressor 101, which allows reduced intake pulsation noise without increasing the size of the air compressor 101 as an assembly.

Figure 5:
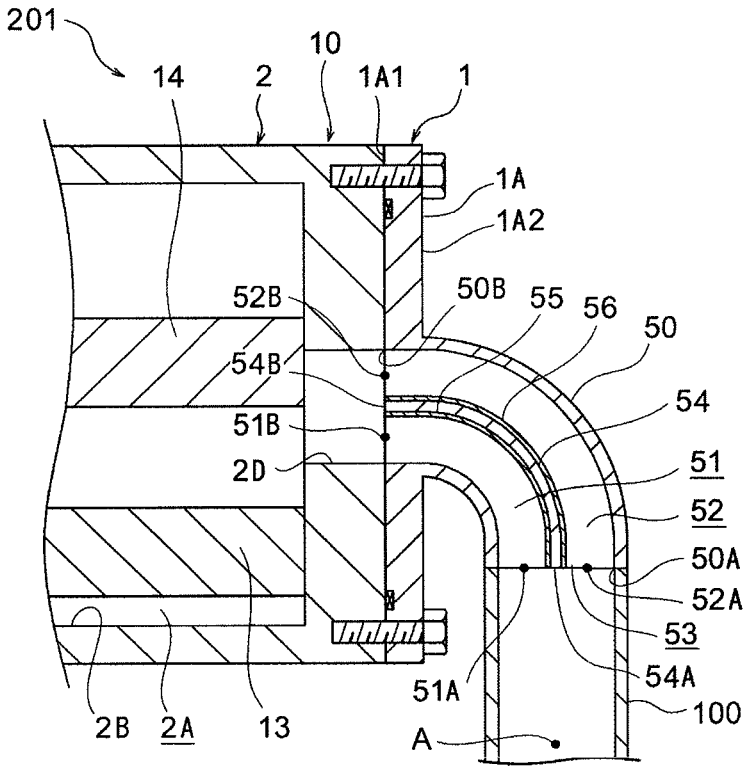
FIG. 5 is a sectional view of an air compressor according to a second embodiment of the present invention.

FIG. 5 shows the second embodiment of the air compressor according to the present invention. The second embodiment differs from the first embodiment in that the partition wall 54 has on the opposite sides thereof sound absorbers. In the drawing, same reference numerals are used for the common elements or components in the first and second embodiments, and the description of such elements or components of the second embodiment will be omitted.

As shown in FIG. 5, the air compressor of the second embodiment designated generally by 201 has sound absorbers 55, 56 such as glass wool for lowering sound pressure level and vibration. In the chamber 53 of the connecting portion 50, the sound absorbers 55, 56 are provided on the opposite sides of the partition wall 54 along the profile of the partition wall 54, facing the inner peripheral surfaces of the respective first and second chambers 51, 52.

When the acoustic waves of intake pulsation noise generated from the compression mechanism 10 pass through the first and second chambers 51, 52, the acoustic waves are dampened by the respective sound absorbers 55, 56 and the sound pressure level of the waves is lowered. Then the acoustic waves of lowered sound pressure levels are joined and cancelled in the intake tube 100 at a position adjacent to the inlet 50A, so that the sound pressure level is further lowered, as compared to the air compressor 101 of the first embodiment. Furthermore, the sound absorbers 55, 56 prevents the vibration of the partition wall 54 and also the vibration of the connecting portion 50 due to the intake pulsation noise.

Thus, the air compressor 201 of the second embodiment offers the advantages similar to those of the first embodiment.

The air compressor 201 has the sound absorbers 55, 56 on the partition wall 54. This results in a reduction of sound pressure level of acoustic waves after passing through the first and second chambers 51, 52, thereby further lowering sound pressure level of the intake pulsation noise at the inlet 50A of the connecting portion 50. This reduction of sound pressure level of the intake pulsation noise at the inlet 50A is achieved by providing either one of the sound absorbers 55, 56.

Although in the previous embodiments the partition wall 54 is formed by a single continuous wall, a plurality of spaced walls may be provided in the connecting portion 50 of the rear housing 1. The lengths of the respective walls and the spaced intervals may be determined depending on the wave length of the intake pulsation noise whose sound pressure level is to be lowered.

Although in the previous embodiments the partition wall 54 extends from the inlet 50A to the outlet 50B in the connecting portion 50, the ends 54A, 54B of the partition wall 54 may not necessarily extend to the respective inlet and outlet 50A, 50B, but the end 54B of the partition wall 54 on the side thereof adjacent to the pump chamber 2A may extend into the hole 2D.

Although in the previous embodiments the partition wall 54 is formed so as to provide two flow passages, namely, the first and second chambers 51, 52, the number of flow passages is not limited. Three or more passages may be formed by changing the shape of the partition wall or the number of partition walls.

Although in the previous embodiments the first and second chambers 51, 52 have the same cross-sectional area, the first and second chambers 51, 52 may be so formed that their cross-sectional areas are different from each other.

Although in the previous embodiments the air compressors 101, 201 are roots compressors, the present invention is applicable to an air compressor such as a screw compressor in which high frequency intake pulsation occurs.

What is claimed is:

1. An air compressor, comprising:

a compression mechanism having a pump chamber, an intake port thereof and a discharge port thereof, wherein the pump chamber of the compression mechanism compresses intake air introduced through the intake port and discharges the compressed air through the discharge port; and an intake chamber through which intake air is introduced into the compression mechanism, the intake chamber having an inlet connected directly to an intake tube for the intake air and an outlet connected to the intake port of the compression mechanism, wherein fresh air is introduced through the intake tube into the intake chamber, wherein the intake chamber is integrated with the compression mechanism, the intake chamber includes an internal surface that defines a flow passage extending from the inlet to the outlet, the intake chamber has therein a partition wall extending between points on the internal surface from the inlet to the outlet to divide the flow passage into plural flow passages, the plural flow passages have different flow path lengths and connect between the inlet and the outlet.

2. The air compressor according to claim 1, wherein a direction in which the inlet is opened is different from a direction in which the outlet is opened.

3. The air compressor according to claim 1, wherein the plural flow passages have a same cross-sectional area.

4. The air compressor according to claim 1, wherein the partition wall has a sound absorber.

5. The air compressor according to claim 1, wherein the intake chamber cooperates with the compression mechanism to form an air compressor assembly.

* * * * *